US010081471B2

(12) United States Patent
Barkerding et al.

(10) Patent No.: US 10,081,471 B2
(45) Date of Patent: Sep. 25, 2018

(54) BEVERAGE CARRIER WITH DETACHABLE SLEEVES AND METHOD FOR MAKING THE SAME

(71) Applicant: SmartPak, LLC, New Orleans, LA (US)

(72) Inventors: T. Pike Barkerding, New Orleans, LA (US); Robert Henry Post, Covington, LA (US)

( * ) Notice: Subject to any disclaimer, the term of this patent is extended or adjusted under 35 U.S.C. 154(b) by 0 days.

(21) Appl. No.: 14/831,135

(22) Filed: Aug. 20, 2015

(65) Prior Publication Data

US 2017/0050790 A1 Feb. 23, 2017

Related U.S. Application Data

(63) Continuation of application No. 14/583,387, filed on Dec. 26, 2014, now Pat. No. 9,327,889.

(Continued)

(51) Int. Cl.
*B65D 75/00* (2006.01)
*B65D 71/48* (2006.01)

(Continued)

(52) U.S. Cl.
CPC ..... *B65D 71/48* (2013.01); *B31B 50/00* (2017.08); *B31B 50/26* (2017.08); *B31B 50/60* (2017.08);

(Continued)

(58) Field of Classification Search
CPC ..... B65D 2571/00141; B65D 2571/00475; B65D 2571/0066; B65D 2571/00802;

(Continued)

(56) References Cited

U.S. PATENT DOCUMENTS 2,998,899 A * 9/1961 Donafo ..... B65D 71/0003 206/203
3,359,873 A * 12/1967 Carle ..... B65D 71/0003 206/203

(Continued)

FOREIGN PATENT DOCUMENTS

KR 10-2008-0045474 A 5/2008
KR 10-2011-0112931 A 5/2013

OTHER PUBLICATIONS

U.S. Appl. No. 14/583,387, filed Dec. 26, 2014, Barkerding.

(Continued)

*Primary Examiner* — Anthony Stashick
*Assistant Examiner* — Kaushikkumar Desai
(74) *Attorney, Agent, or Firm* — AdamsIP, LLC; Stephen Thompson; J. Hunter Adams

(57) ABSTRACT

A beverage carrier for holding, storing, and carrying beverages is provided. The carrier has a handle and six or more individually detachable sleeves arranged in two rows on each side of the handle. When a sleeve is detached from the carrier, with a beverage remaining within the sleeve, the sleeve serves as an insulating device for the beverage. The beverage carrier is manufactured from a template, which is a single, continuous piece of generally flat material such as cardboard or paperboard. The end sleeves of each row of sleeves is attached directly to the handle, and the middle sleeves are attached to the handle via a hinge that allows the middle sleeves to be folded into place between the end sleeves. The hinges allow the template to be made from a single piece of material without any overlapping material. Because the carrier is made from such a template, a high volume of carriers can be manufactured using automated machinery.

7 Claims, 14 Drawing Sheets

Related U.S. Application Data

(60) Provisional application No. 61/921,404, filed on Dec. 27, 2013.

(51) Int. Cl.

| | |
|---|---|
| ***B65D 71/40*** | (2006.01) |
| ***B65D 71/12*** | (2006.01) |
| ***B65D 81/38*** | (2006.01) |
| ***B31B 50/00*** | (2017.01) |
| ***B31B 50/26*** | (2017.01) |
| ***B31B 50/60*** | (2017.01) |
| *B65B 3/00* | (2006.01) |
| *B31B 50/81* | (2017.01) |
| *B31B 100/00* | (2017.01) |
| *B31B 105/00* | (2017.01) |
| *B31B 120/00* | (2017.01) |
| *B31B 120/20* | (2017.01) |

(52) U.S. Cl.

CPC ..... *B65D 71/125* (2013.01); *B65D 71/406* (2013.01); *B65D 81/3876* (2013.01); *B31B 50/81* (2017.08); *B31B 2100/00* (2017.08); *B31B 2105/00* (2017.08); *B31B 2120/00* (2017.08); *B31B 2120/20* (2017.08); *B65B 3/00* (2013.01); *B65D 2571/0066* (2013.01); *B65D 2571/00141* (2013.01); *B65D 2571/00475* (2013.01); *B65D 2571/00802* (2013.01)

(58) Field of Classification Search

CPC .. B65D 71/125; B65D 71/403; B65D 71/406; B65D 71/48; B65D 71/52

USPC ..... 206/141, 143, 150, 151, 427; 493/162

See application file for complete search history.

(56) References Cited

U.S. PATENT DOCUMENTS

| | | | | |
|---|---|---|---|---|
| 3,908,523 | A | 9/1975 | Shikaya | |
| 3,948,388 | A * | 4/1976 | Mueller | B65D 71/40 206/192 |
| 4,645,072 | A * | 2/1987 | Lemon | B65D 71/0022 206/143 |
| 5,458,234 | A | 10/1995 | Harris | |
| 5,562,205 | A | 10/1996 | Diaz | |
| 6,026,983 | A * | 2/2000 | Graham | A47G 23/0216 220/738 |
| 7,832,553 | B2 * | 11/2010 | Hartness | B29C 63/423 206/150 |
| 7,850,003 | B2 * | 12/2010 | Hartness | B65D 71/08 206/150 |
| 2005/0056654 | A1 | 3/2005 | Leung | |
| 2008/0272013 | A1 * | 11/2008 | Hartness | B29C 63/423 206/139 |
| 2011/0056175 | A1 * | 3/2011 | Harness | B29C 63/423 53/442 |

OTHER PUBLICATIONS

Preliminary Amendment filed Jul. 2, 2015 in U.S. Appl. No. 14/583,387.

Restriction Requirement dated Aug. 13, 2015 in U.S. Appl. No. 14/583,387.

Response to Restriction Requirement filed Oct. 13, 2015 in U.S. Appl. No. 14/583,387.

Non-final OA dated Nov. 25, 2015 in U.S. Appl. No. 14/583,387.

Amendment filed Feb. 21, 2016 in U.S. Appl. No. 14/583,387.

Notice of Allowance dated Mar. 15, 2016 in U.S. Appl. No. 14/583,387.

Appl. No. PCT/US14/72440 filed Dec. 26, 2014, Barkerding.

Appl. No. PCT/US14/72440 International Search Report and Written Opinion dated Apr. 24, 2015.

Chapter II Demand with amendments, filed Jul. 28, 2015 in Appl. No. PCT/US14/72440.

Appl. No. PCT/US14/72440 International Preliminary Report on Patentability dated Apr. 12, 2016.

Appl. No. PCT/US15/46014 filed Aug. 20, 2015, Barkerding.

Appl. No. PCT/US15/46014 Written Opinion dated Oct. 30, 2015.

Design U.S. Appl. No. 29/513,123, filed Dec. 26, 2014, Barkerding.

Notice of Allowance dated Aug. 26, 2015 in Design U.S. Appl. No. 29/513,123.

* cited by examiner

BEVERAGE CARRIER WITH DETACHABLE SLEEVES AND METHOD FOR MAKING THE SAME

CROSS REFERENCES

This application claims the benefit of U.S. Provisional Application No. 61/921,404, filed on Dec. 27, 2013, and U.S. application Ser. No. 14/583,387, filed on Dec. 26, 2014, which applications are incorporated herein by reference.

BACKGROUND OF THE INVENTION

I. Field of the Invention

The present invention relates to beverage carriers, and more specifically to beverage carriers comprising detachable insulating sleeves and the method of making said beverage carriers.

II. Description of Related Art

Beverage carriers are used, generally, to hold and transport one or more beverage containers. Commonly, beverage carriers are used to hold six individual glass bottles (i.e., a six-pack) so that they can be stored and transported easily. These six-pack carriers are typically made from a single, continuous piece of cardboard or paperboard and are assembled using automated systems capable of cutting, folding, and gluing the beverage carriers. Automated systems typically utilize generally flat cardboard or paperboard templates and fold the flat templates to form a three-dimensional beverage carrier. Commonly used beverage carriers often have six individual slots for holding a beverage container such as a glass bottle. When a user desires to open and drink the beverages contained within the carrier, the user generally lifts each of the beverages out of its respective slot in the carrier. The user subsequently discards the carrier once all individual beverages are removed.

While drinking a beverage, the user may desire to keep his or her beverage insulated from external heat sources, such as heat from the environment or heat from the user's hand, during consumption by inserting the beverage into an insulating device (for example, a Koozie®, huggie, can coolers, etc.). However, the user may often find himself or herself without a can cooler and thus unable to easily insulate his or her beverage.

Accordingly, a need exists in the art for a beverage carrier comprising six or more insulating sleeves that can each be individually detached from the carrier while retaining its structure such that the sleeve can surround a beverage container as a user is drinking the beverage, thereby insulating the beverage from external heat sources such as heat from the environment or heat from the user's hand during consumption. However, production of such a beverage carrier having individually detachable sleeves may cause problems for automated manufacturing systems. Because the beverage carrier must comprise individual sleeves that can be detached while retaining their structure and not just slots for holding beverage containers, the template used to make the beverage carrier must also comprise material for forming each individual sleeve. However, because automated systems will cut each template from a larger piece of cardboard or paperboard, the material used to form each individual sleeve also cannot overlap. Particularly with respect to carriers holding six or more beverages, as is common in the industry, this creates a problem because known templates having standard, commonly used shapes cannot be used to make a six-pack carrier having individually detachable sleeves.

Accordingly, a need exists in the art for a beverage carrier template made from a single, continuous piece of material configured for manufacturing a beverage carrier having six or more individually detachable sleeves that each retains its structure after detachment. Furthermore, a need exists in the art for a method of manufacturing a beverage carrier using such a template.

BRIEF SUMMARY OF THE INVENTION

One aspect of the present invention provides for a beverage carrier for carrying six or more individual beverage containers. The beverage carrier comprises a handle and six or more individual sleeves wherein each of the sleeves is configured such that each sleeve can be individually detached from the handle and remain structurally intact. When carrying beverages in the carrier, each sleeve surrounds one beverage container. Thus, a user of the device can detach a sleeve containing a beverage container, such as a bottle or can filled with a beverage, and drink the beverage with the sleeve surrounding the beverage container. The sleeve insulates the beverage from external heat sources, such as heat from the environment or heat from the user's hand. Conversely, the sleeve also protects the user's hand from becoming too cold when holding a cold beverage container. Additionally, although the device is typically used to insulate cold beverages, it may also be used in the same manner to insulate hot beverages and to protect a user's hand from the heat of the beverage.

Another aspect of the present invention provides for a beverage carrier comprising a handle and six or more sleeves arranged in a first row on one side of the handle and a second row on the opposite side of the handle. Thus, each row has two end sleeves and at least one middle sleeve. Each of the sleeves is attached to the handle along a perforated attachment surface such that each sleeve can then be detached from the handle simply by tearing the sleeve away from the handle along the perforated attachment surface. Each perforated attachment surface is preferably configured in a generally vertical position such that the perforations extend vertically along the exterior surface of each respective sleeve when the assembled beverage carrier is in an upright position. Thus, each sleeve is attached to the handle along a generally straight and generally vertical perforated attachment surface rather than a curved attachment surface extending around the circular perimeter of the sleeve. This configuration provides a strong and effective attachment along the perforated attachment surface while allowing the straight edge of the handle to remain straight and providing a sleeve that fits snugly around the entire circular perimeter of a beverage container, which provides effective insulation.

Another aspect of the present invention provides for a beverage carrier template made from a single, continuous, and generally flat piece of material configured for manufacturing a beverage carrier having six or more individually detachable sleeves that each retains its structure after detachment. In a preferred embodiment, the template produces a six-pack beverage carrier having a row of three separate sleeves for holding beverages on each side of a handle. Thus, the generally flat template comprises a pre-formed handle and three pre-formed sleeves attached to each side of the pre-formed handle such that each side of the pre-formed handle has two pre-formed end sleeves and one pre-formed middle sleeve. In order to cut the template from a single piece of material without overlapping the material used to form the sleeves, the material for each of the middle sleeves is connected to the rest of the template by a hinge. The hinges allow this material to be formed into the middle sleeves and then folded into place between the end sleeves. Once the middle sleeves are in place, they are glued or otherwise attached to the handle and the hinges can then be removed. The hinges allow the template to be cut from a single piece of material such as cardboard or paperboard so that a high volume of beverage carriers can be manufactured quickly using automated systems.

Another aspect of the present invention provides a method of manufacturing a beverage carrier from such a template. Each of the four pre-formed end sleeves (two on each side of the handle) is attached directly to the pre-formed handle along an attachment surface. The pre-formed middle sleeves are attached indirectly to the pre-formed handle via each of the hinges. Perforations are then made along each of the attachment surfaces such that each of the end sleeves can be individually detached from the carrier. Next, a section of continuous perforations is made on each side of the pre-formed handle to form a perforated attachment panel on each side the pre-formed handle. Each of the pre-formed sleeves composing the template is a generally flat piece of material having two opposing ends. Three-dimensional sleeves are then formed by attaching the opposing ends of each of the pre-formed sleeves to each other. The middle sleeves are then folded into place between the end sleeves, and the exterior surface of each middle sleeve is attached to a corresponding perforated attachment panel. Next, the pre-formed handle is folded in half to form a handle having three sleeves attached to each side of the handle. Thus, the assembled beverage carrier is generally symmetrical and has six sleeves arranged in two rows of three sleeves on each side of the handle.

BRIEF DESCRIPTION OF THE DRAWINGS

These and other features, aspects, and advantages of the present invention will become better understood with regard to the following description, appended claims, and accompanying drawings where:

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate manner.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The present invention provides for a carrier for holding six or more containers wherein said containers are each separately enclosed by a sleeve, and each sleeve can be individually detached from the remainder of the carrier. When each sleeve is detached from the remainder of the carrier, each sleeve remains structurally intact. In a preferred use of the present invention, the carrier holds a six-pack of bottled or canned beverages, such as beer or soda. Another feature of the present invention is that each of the sleeves serves to insulate the beverage contained therein, both while the sleeves are attached to the carrier and after they have been removed from the remainder of the carrier. Because of the detachable insulated sleeves, the user does not have to use an additional insulating device, wherein said insulating devices are also referred to as koozies, huggies, can coolers, etc. The carrier of the present invention is preferably made of cardboard or paperboard, but can be made from other types of materials, including, but not limited to, posterboard, corrugated cardboard, corrugated plastic, plastic sheeting, and other similar materials known in the art.

Figure 6:
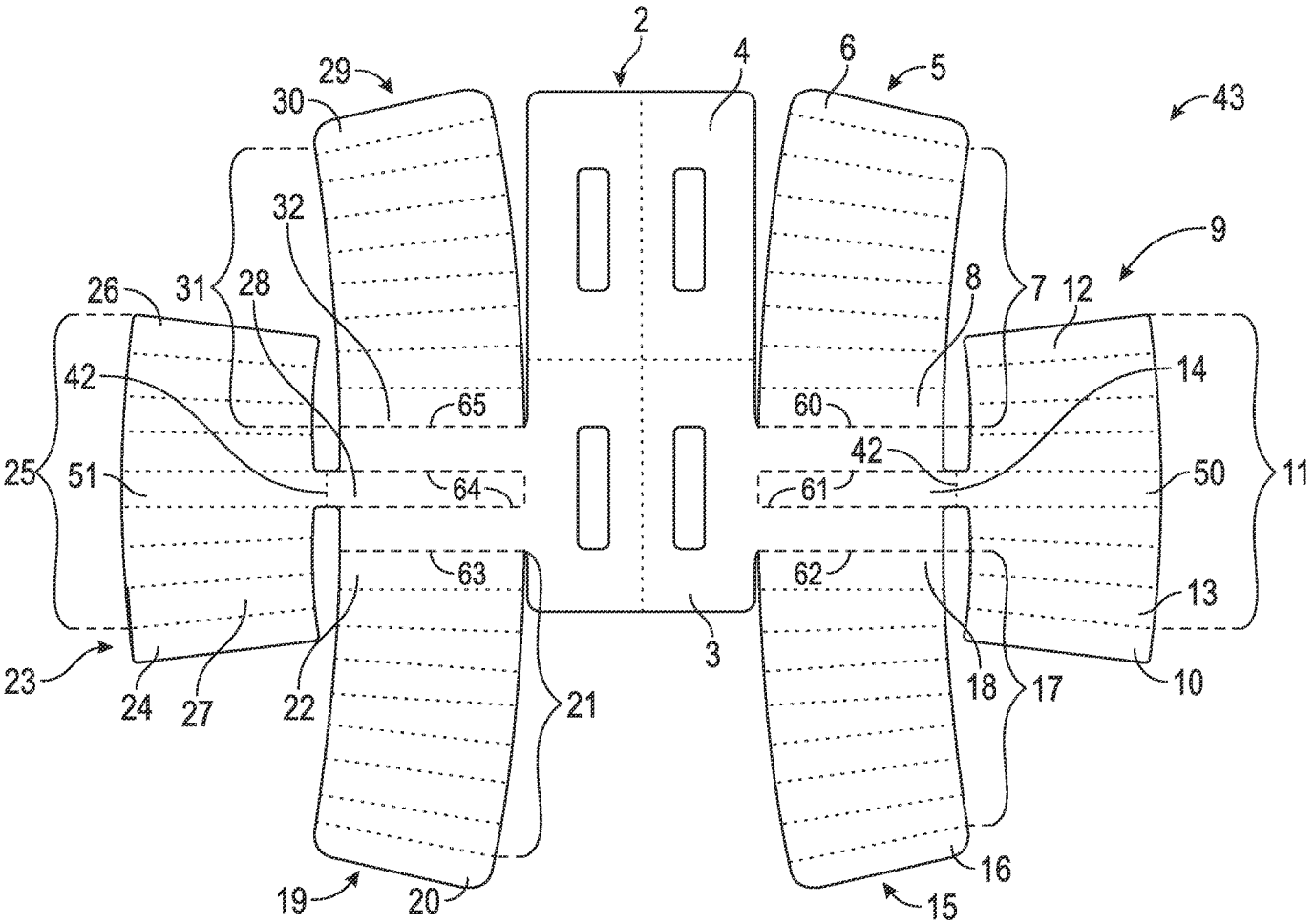
FIG. 6 depicts an elevational view of a paperboard blank cut to create one embodiment of the beverage carrier of the present invention.
Figure 7:
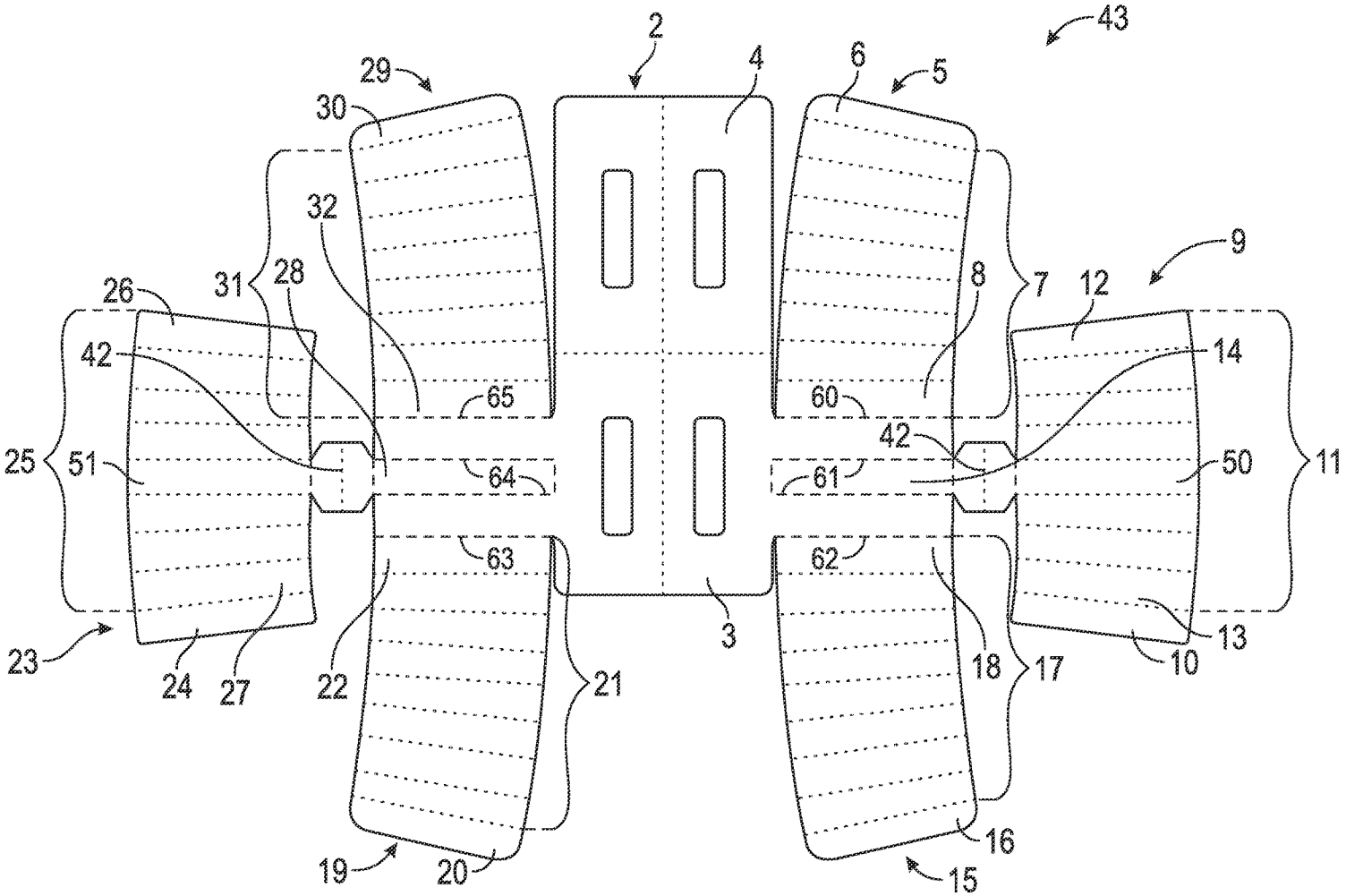
FIG. 7 depicts an elevational view of a paperboard blank cut to create one embodiment of the beverage carrier of the present invention.
Figure 8:
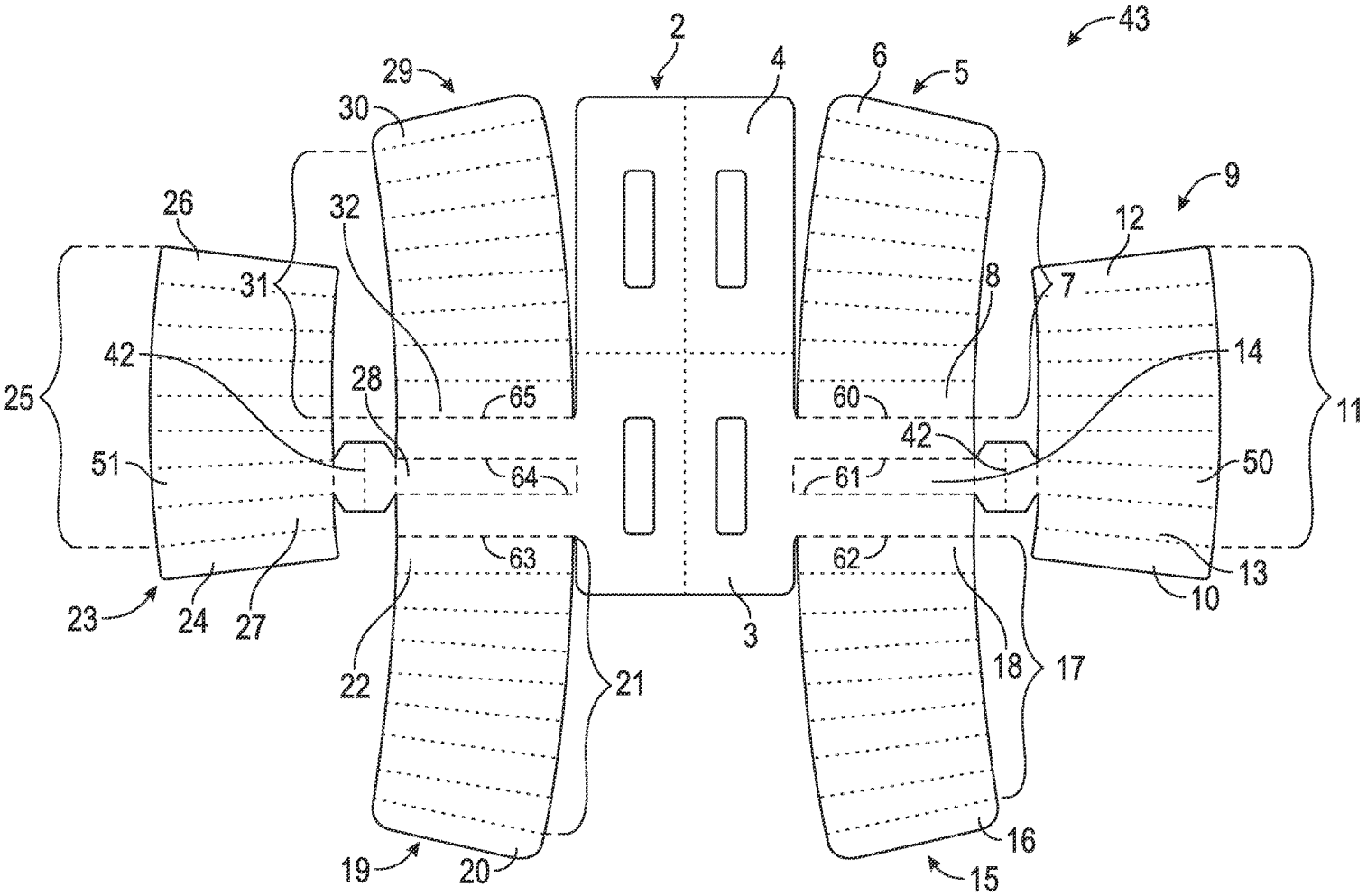
FIG. 8 depicts an elevational view of a paperboard blank cut to create one embodiment of the beverage carrier of the present invention.

As described in greater detail below, the beverage carrier 1 of the present invention is manufactured from a generally flat cut-out template 43, preferably made of paperboard. FIGS. 6-8 illustrate exemplary templates 43 used to manufacture a carrier having six sleeves for carrying six individual beverage containers. In this embodiment, each template 43 comprises a pre-formed handle 2 and six pre-formed sleeves 5, 9, 15, 19, 23, 29. As used herein, the term "pre-formed handle" refers to a generally flat piece of material, being part of a template, wherein said flat piece of material is configured such that it can be folded in order to form a handle. Similarly, as used herein, the term "pre-formed sleeve" refers to a generally flat piece of material having opposing ends that can be attached to each other in order to form a three-dimensional sleeve.

FIGS. 1-5 illustrate a completely assembled beverage carrier 1 having six sleeves 5, 9, 15, 19, 23, 29. We speculate that the carrier 1 of the present invention utilizes less material and glue than the average beverage carrier already in the marketplace, and that it can be assembled using automated machinery, though it may also be assembled by hand. Additionally, we speculate that the construction of the carrier 1 of the present invention requires fewer steps than the method of constructing the average beverage carrier already in the marketplace.

Figure 2:
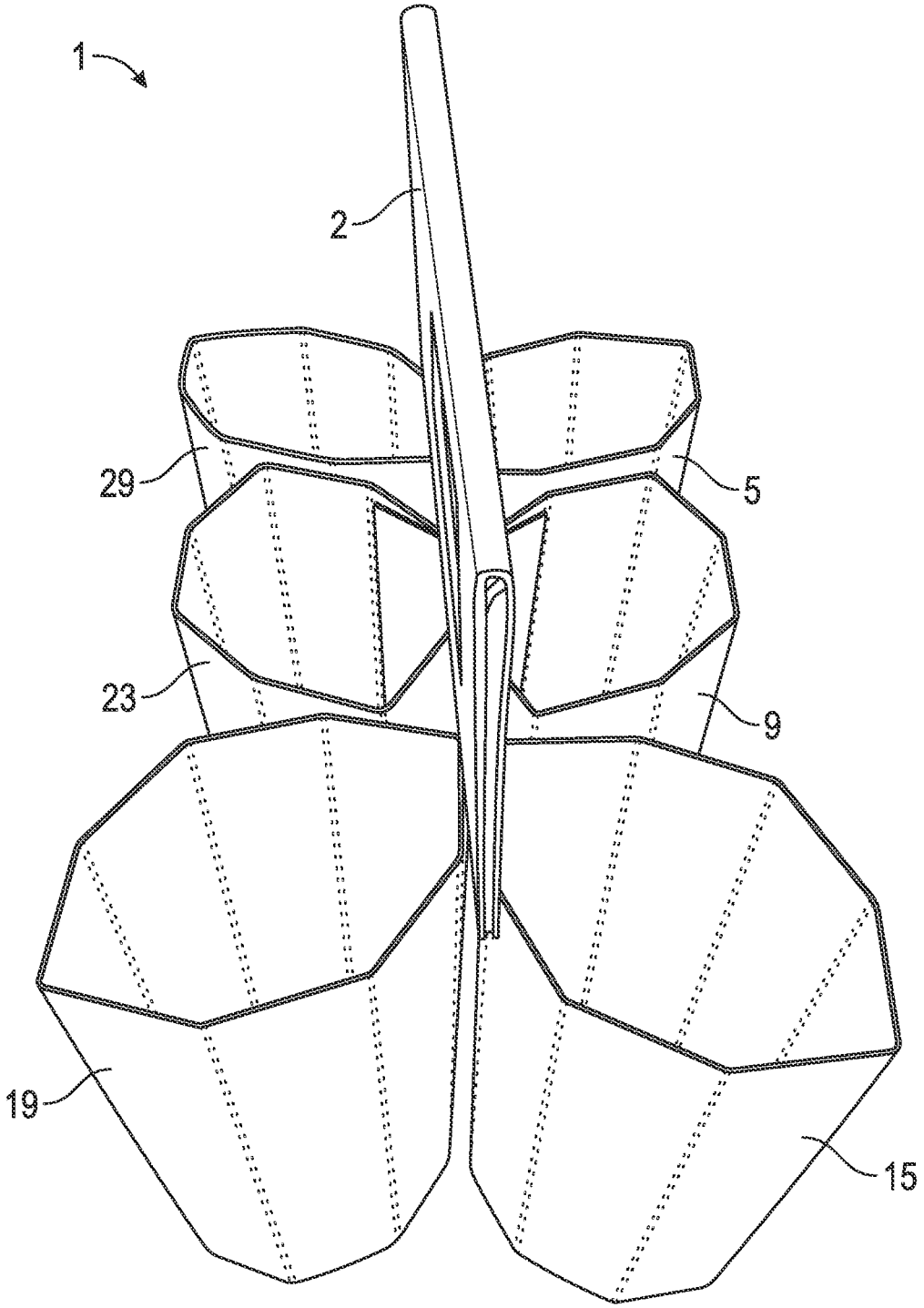
FIG. 2 depicts a perspective view of the beverage carrier of the present invention.

As can be seen in FIG. 2, the beverage carrier 1 preferably comprises six sleeves 5, 9, 15, 19, 23, 29 arranged in two parallel rows of three sleeves each, with each row disposed along a length on one side of a handle 2. Specifically, a first sleeve 5, second sleeve 9, and third sleeve 15 are attached to one side of the handle 2 while a fourth sleeve 19, fifth sleeve 23, and sixth sleeve 29 are attached to the opposite side of the handle 2. Thus, each row of sleeves has two end sleeves and one middle sleeve. In this embodiment, the first sleeve 5, third sleeve 15, fourth sleeve 19, and sixth sleeve 29 are the end sleeves, and the second sleeve 9 and fifth sleeve 23 are the middle sleeves. In alternative embodiments, the beverage carrier 1 may comprise more than six sleeves, in which case each row would comprise two end sleeves and at least two middle sleeves.

Figure 1:
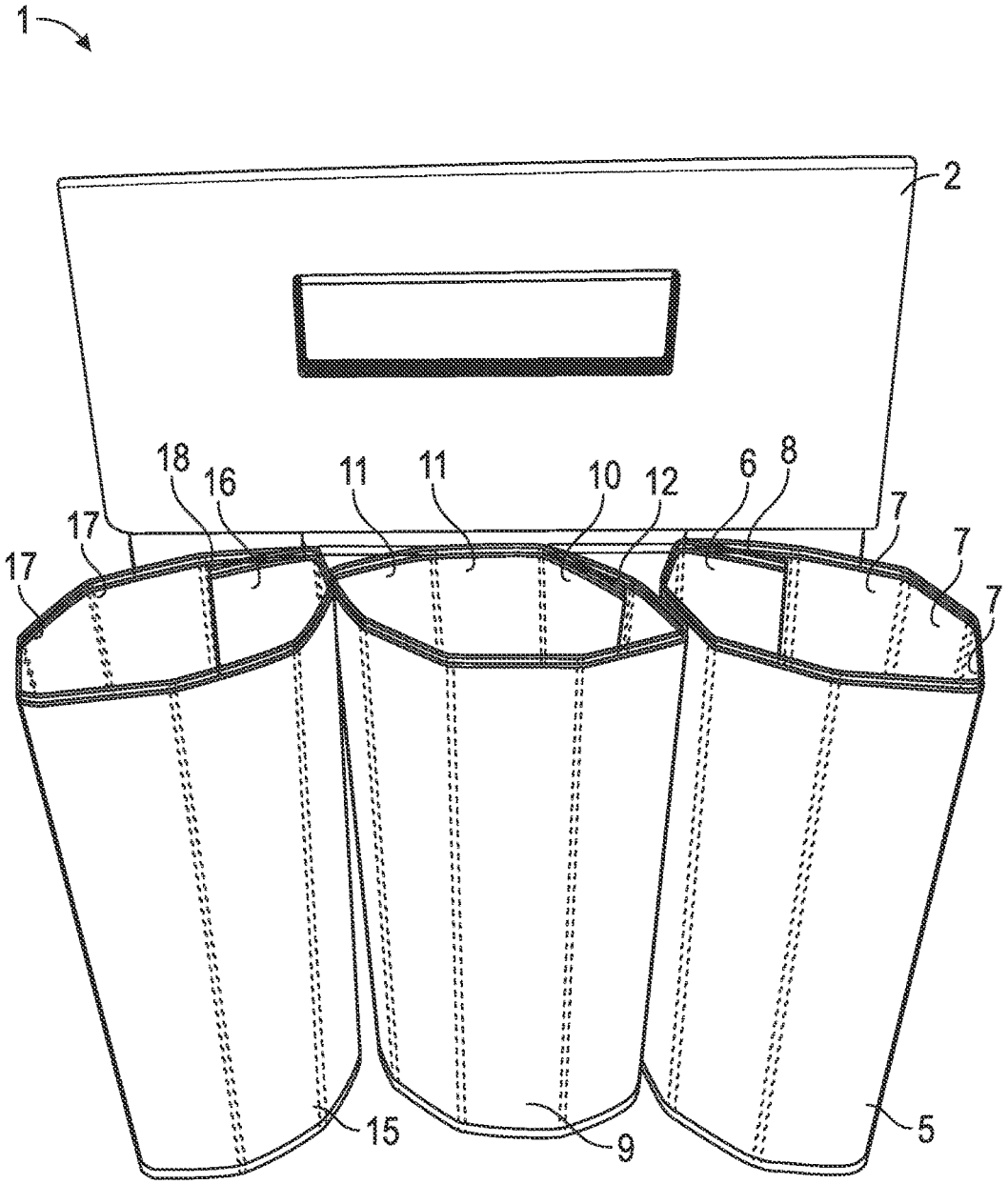
FIG. 1 depicts a side view of the beverage carrier of the present invention.

As shown, for example, in FIGS. 1 and 7, each sleeve 5, 9, 15, 19, 23, 29 comprises a sleeve attachment flap 6, 10, 16, 20, 24, 30 and a series of sleeve panels 7, 11, 17, 21, 25, 31. One of said sleeve panels 7, 11, 17, 21, 25, 31 of each sleeve 5, 9, 15, 19, 23, 29 is a sleeve attachment panel 8, 12, 18, 22, 26, 32. FIGS. 6-8 illustrate templates 43 having six generally flat pre-formed sleeves 5, 9, 15, 19, 23, 29. Once assembled into a beverage carrier 1, each sleeve 5, 9, 15, 19, 23, 29 has a generally cylindrical shape and is formed by attaching each sleeve attachment flap 6, 10, 16, 20, 24, 30 to each respective sleeve attachment panel 8, 12, 18, 22, 26, 32. Each sleeve attachment flap 6, 10, 16, 20, 24, 30 may be attached to each respective sleeve attachment panel 8, 12, 18, 22, 26, 32 using glue (such as a wet set glue) or, alternatively, using interlocking tabs, structured board (i.e., one-way insertion methods), hinges, tacks, staples, zippers, hook and loop tape (e.g., "Velcro"), sewn thread, springs, clips, buckles, hooks, magnets, nails, screws, suction, or any similar attachment means know in the art.

For example, and as shown in FIG. 1, to create the generally cylindrical shape of the first sleeve 5, said first sleeve attachment flap 6 is glued to the first sleeve attachment panel 8. Similarly, to create the cylindrical shape of the second sleeve 9, said second sleeve attachment flap 10 is glued to the second sleeve attachment panel 12. This same method of creating the generally cylindrical shaped sleeves is repeated for each individual sleeve (e.g., the third sleeve 15, the fourth sleeve 19, the fifth sleeve 23 and the sixth sleeve 29).

In addition, the pre-formed sleeves 5, 9, 15, 19, 23, 29 may first be creased so as to create a series of sleeve panels 7, 11, 17, 21, 25, 31 in each of the sleeves 5, 9, 15, 19, 23, 29. Before each sleeve is formed into a generally cylindrical shape, each pre-formed sleeve 5, 9, 15, 19, 23, 29 may be creased, or folded to create creases, at intervals along one or more latitudinal lines to create two or more sleeve panels 7, 11, 17, 21, 25, 31 for each sleeve 5, 9, 15, 19, 23, 29. The locations of exemplary creases in the sleeves 5, 9, 15, 19, 23, 29 are shown in FIGS. 1-5 by dotted lines. Preferably, creases are made at approximately one inch intervals along the length of each of the pre-formed sleeves 5, 9, 15, 19, 23, 29 to create eight sleeve panels 7, 11, 17, 21, 25, 31 in each sleeve 5, 9, 15, 19, 23, 29. However, a greater or lesser number of creases may be included to create more or fewer sleeve panels 7, 11, 17, 21, 25, 31. The creasing of the sleeves 5, 9, 15, 19, 23, 29 to create sleeve panels 7, 11, 17, 21, 25, 31 allows the material making up the sleeves 5, 9, 15, 19, 23, 29 to more easily bend into a generally cylindrical shape. Additionally, the creasing of the sleeves 5, 9, 15, 19, 23, 29 allows for the beverage carrier 1 to be compressed flat after all beverage containers have been removed from the beverage carrier 1, and thus allows for easy storage or disposal of the beverage carrier 1.

As illustrated in FIGS. 6-8, the second sleeve 9 and the fifth sleeve 23 each further comprise a second sleeve inner attachment panel 13 and a fifth sleeve inner attachment panel 27, respectively, as well as a second sleeve center attachment panel 50 and a fifth sleeve center attachment panel 51, respectively. In a preferred embodiment, as illustrated in FIG. 7, the bottom side of each of the second and fifth sleeve inner attachment panels 13, 27 is attached to the top side of a corresponding handle attachment panel 14 and 28, respectively, during manufacturing of the beverage carrier 1 (as described in further detail below). In an alternative embodiment, the top side of each of the second and fifth sleeve center attachment panels 50, 51 is attached to the top side of each corresponding handle attachment panel 14 and 28, respectively, during manufacturing. The process of manufacturing the beverage carrier 1 will be discussed below in detail.

Figure 11:
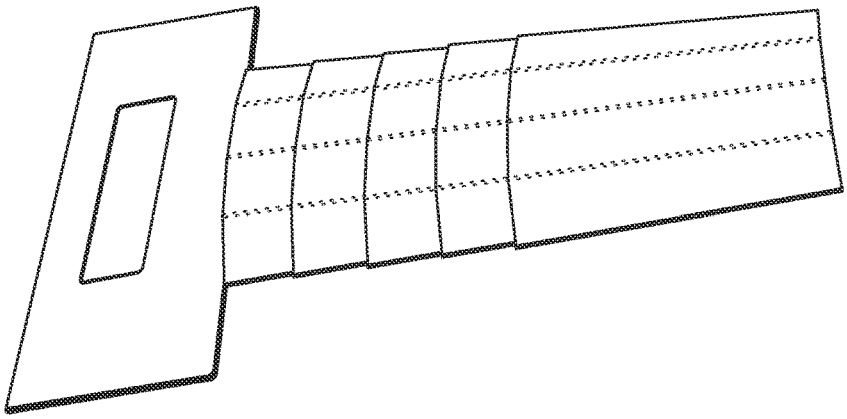
FIG. 11 depicts an elevational view of the storage of each of the sleeve bodies, after removal from the beverage carrier, using the handle of said beverage carrier.
Figure 12:
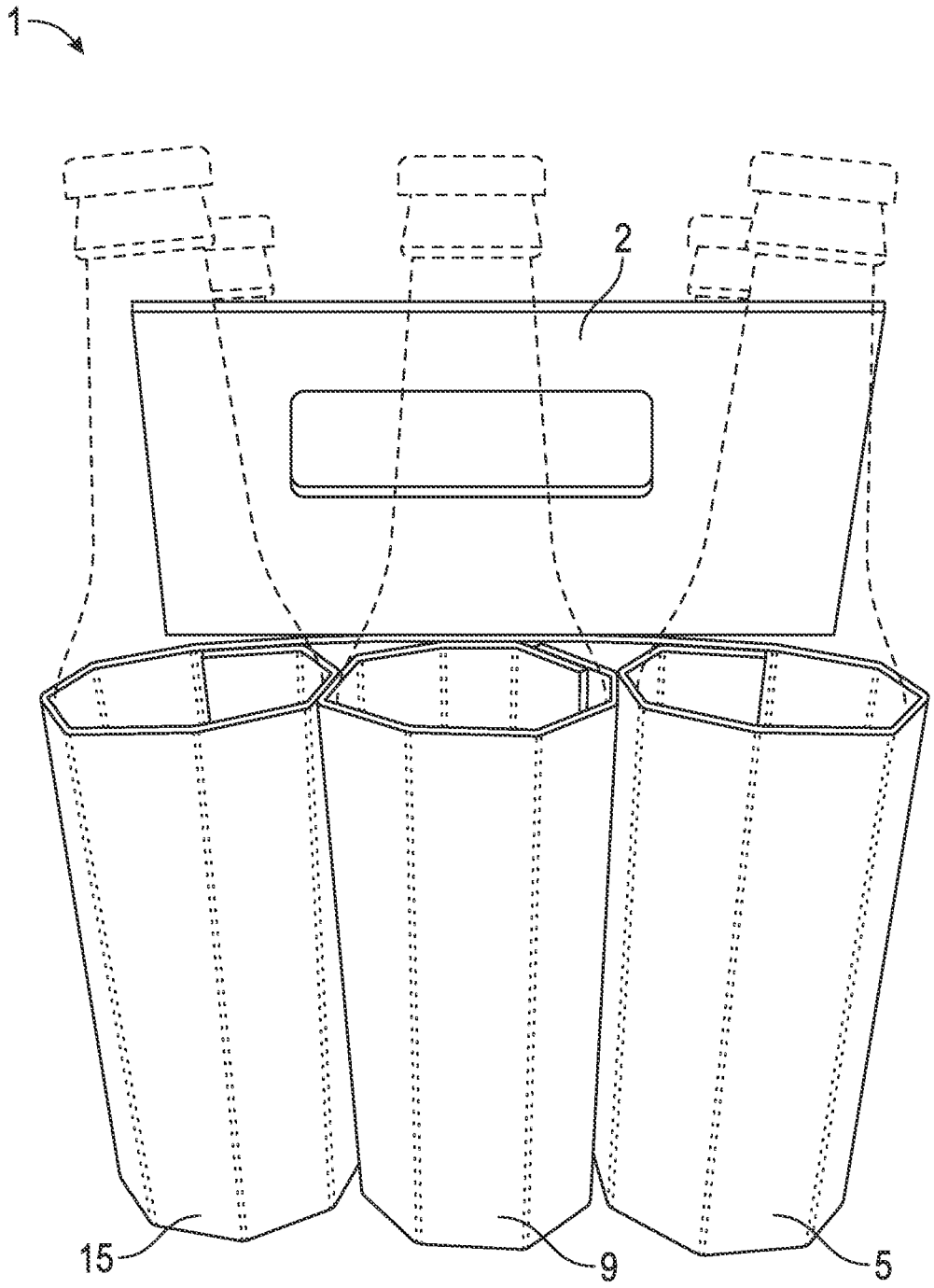
FIG. 12 depicts a front view of the beverage carrier of the present invention with bottles inserted into the sleeve bodies.
Figure 13:
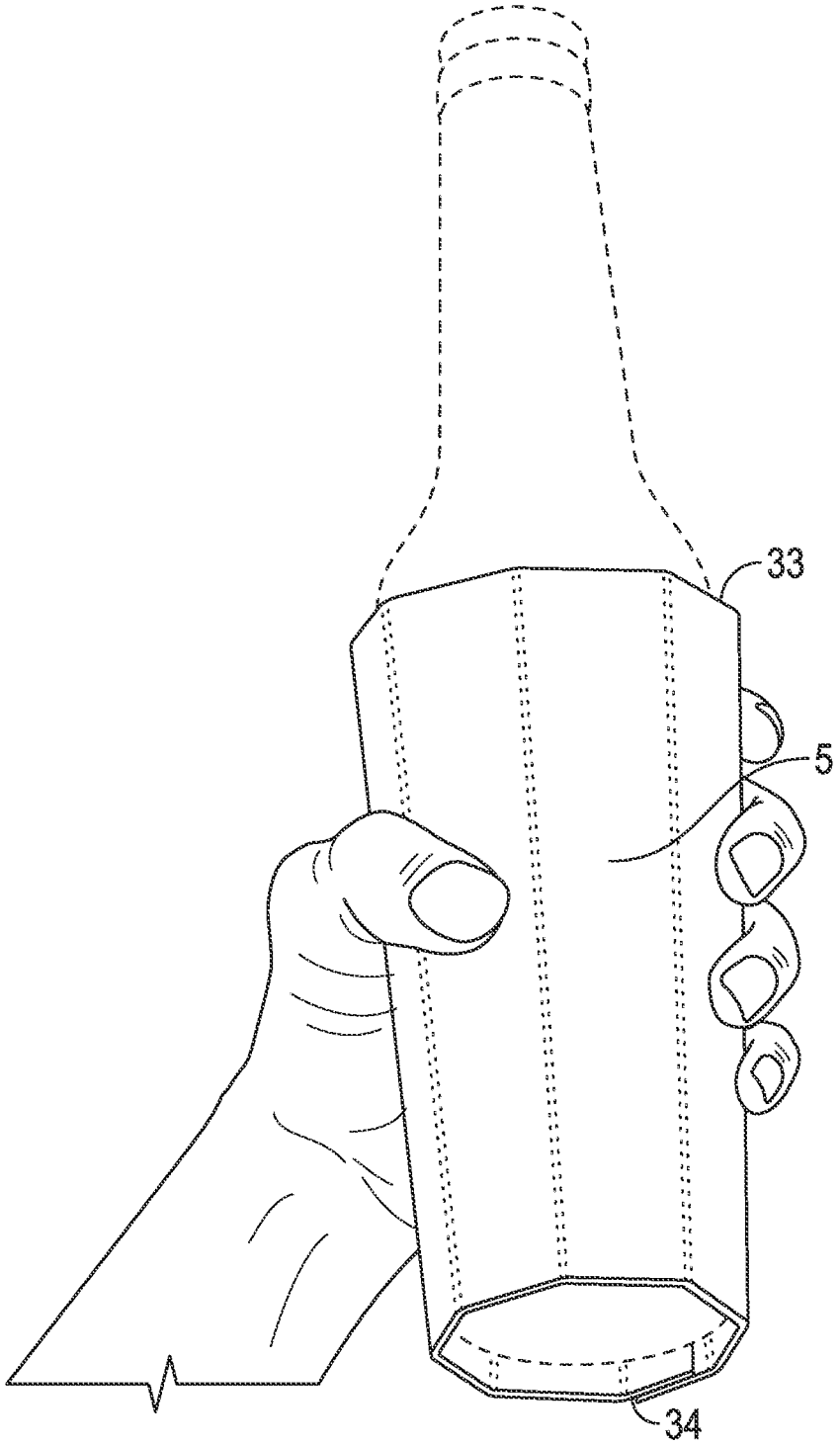
FIG. 13 depicts a beverage container within a detached sleeve of the beverage carrier.

The sleeves 5, 9, 15, 19, 23, 29 shown in FIGS. 1-5 and 10-14 are approximately five inches tall. However, the sleeves can be taller or shorter depending on manufacturer and/or customer preferences. Another feature of the sleeves, as shown in FIG. 13, is that the upper sleeve circumference 33 is greater than that of the lower sleeve circumference 34. Because the upper sleeve circumference 33 is greater, the tapered sleeve design allows a container to be placed into the sleeve from the top of the sleeve 9, 15, 19, 23, 29, but prevents the container from sliding completely through the sleeve. In other words, the tapered design of the sleeve secures the container within the sleeve 9, 15, 19, 23, 29. Each of the sleeves shown in these embodiments has an upper sleeve diameter of approximately 2.5 inches when the sleeve is expanded to its largest diameter, for instance, when the sleeve is surrounding a beverage container. Each sleeve has a lower sleeve diameter of approximately 2.125 inches. However, the lower sleeve circumference 34 and the upper sleeve circumference 33 may be smaller or larger to accommodate various sized containers, such as bottles of beer or soda having diameters of various sizes.

Figure 14:
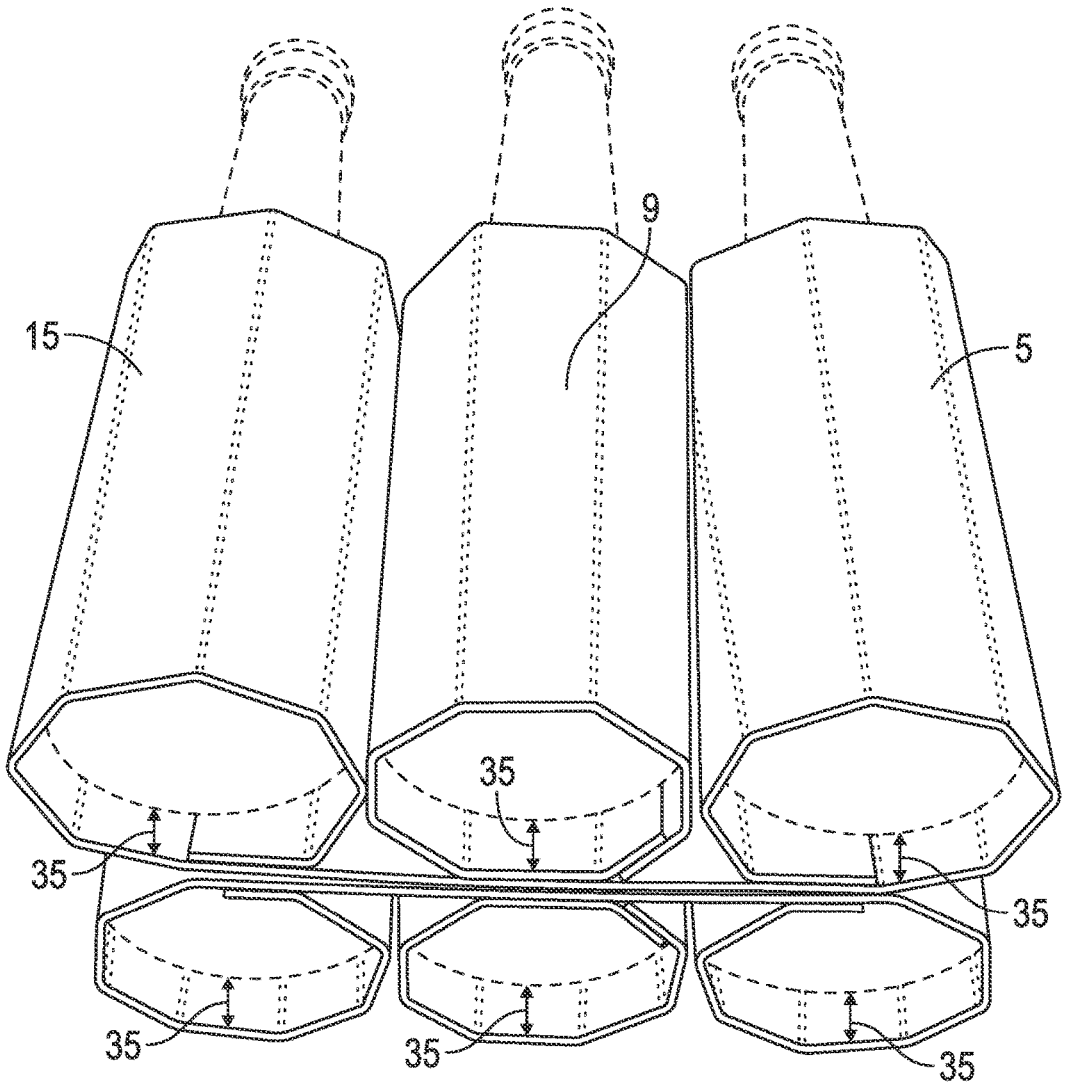
FIG. 14 depicts a perspective view of the beverage carrier of the present invention with bottles inserted into the sleeve bodies.

As can be seen in FIGS. 13 and 14, the particular dimensions of the lower sleeve circumference 34 and the upper sleeve circumference 33 recited above (namely, an upper diameter of 2.5 inches and a lower diameter of 2.125 inches) allow a standard twelve ounce glass beer bottle to be slipped into the top of the sleeve 5, 9, 15, 19, 23, 29 but will not allow the bottle to pass all the way through. It is an additional benefit of this invention that the distance between the bottom of the sleeve 5, 9, 15, 19, 23, 29 and the bottom of the container (the lower void 35) provides added protection to the beverage containers contained within the beverage carrier 1. In this particular embodiment, the lower void 35 is approximately 0.3125 inches long. The lower void 35 aids in preventing glass containers from breaking if the beverage carrier 1 is dropped by the user. The size of the lower void 35 may be adjusted to meet manufacturer and/or customer preferences.

In an alternative embodiment, the lower sleeve circumference and the upper sleeve circumference may be approximately the same, and each beverage container may be supported by a support segment found on each sleeve. In this embodiment (not shown), a support cut is made in each of the sleeves. The cuts are configured in a horizontal position when the sleeves are upright. Preferably, each cut is approximately 1.5 inches long and approximately 0.5 inches from the bottom of the sleeve, though these dimensions may be altered according to manufacturer or customer preferences. The support cuts each create a support segment, which is the material of each sleeve located below a support cut. Making each support cut allows each of the support segments to be pushed inwards towards the center of each of the generally cylindrical sleeves during assembly. Thus, in this design, the inwardly pushed support segment supports the bottom of the beverage container and prevents the container from sliding all the way through the sleeve. In addition, the support cut and support segment can be utilized either in lieu of, or in addition to, the previously described tapered design of the sleeves.

FIGS. 6-8 illustrate exemplary embodiments of a cut-out template 43 used to manufacture a beverage carrier 1 having six sleeves. Each template 43 is a single, generally flat piece of material having a shape comprising a pre-formed handle 2 and six pre-formed sleeves 5, 9, 15, 19, 23, 29 attached to the pre-formed handle 2. The pre-formed handle 2 shown in FIGS. 6-8 is configured such that the pre-formed handle 2 can be folded in half to form a handle 2 as shown in FIGS. 1-4. The material of the pre-formed handle 2 thus comprises at least two openings that align when the pre-formed handle 2 is folded, thereby forming the handle 2. In a preferred embodiment, as shown in FIGS. 6-8, the pre-formed handle 2 comprises four openings and is folded twice so that the four openings align to form the handle 2. In this embodiment, the added material provides the handle 2 with extra strength for carrying beverage containers. The pre-formed handle 2 preferably has creases (as indicated by the dotted lines in FIGS. 6-8) for folding the material to form the handle 2.

As shown in FIGS. 6-8, the pre-formed handle 2 has two sides, and three of the six pre-formed sleeves 5, 9, 15, 19, 23, 29 are attached to each side of the pre-formed handle 2 such that the template 43 produces a beverage carrier 1 having six sleeves arranged in two rows on each side of the handle 2, with each row having two end sleeves and one middle sleeve. Thus, each side of the pre-formed handle 2 has two pre-formed end sleeves 5, 15, 19, 29 and one pre-formed middle sleeve 9, 23 attached thereto.

Each pre-formed sleeve 5, 9, 15, 19, 23, 29 is attached to the pre-formed handle 2 along a respective perforated attachment surface 60, 61, 62, 63, 64, 65, as illustrated in FIGS. 6-8. Each pre-formed sleeve 5, 9, 15, 19, 23, 29 has two opposing ends, which are attached to each other during manufacturing in order to form three-dimensional sleeves. Each respective sleeve attachment flap 6, 10, 16, 20, 24, 30 forms one end of each pre-formed sleeve 5, 9, 15, 19, 23, 29, and each respective sleeve attachment panel 8, 12, 18, 22, 26, 32 forms the other end of each pre-formed sleeve 5, 9, 15, 19, 23, 29. As illustrated in FIGS. 6-8, with respect to the first sleeve 5, the third sleeve 15, the fourth sleeve 19, and the sixth sleeve 29 (the end sleeves), each respective perforated attachment surface 60, 62, 63, 65 is located along each respective sleeve attachment panel 8, 18, 22, 32. Thus, the perforated attachment surface 60, 62, 63, 65 for each end sleeve 5, 15, 19, 29 comprises a single line of perforations.

However, as can also be seen in FIGS. 6-8, each perforated attachment surface 61, 64 for each middle sleeve 9, 23 is defined by a section of continuous perforations, preferably in a rectangular shape. Thus, in a preferred embodiment, the perforated attachment surfaces 61, 64 for each of the middle sleeves 9, 23 form a perforated attachment panel 14, 28 on each side of the pre-formed handle 2. Each perforated attachment panel 14, 28 functions as a handle attachment panel for attaching the exterior surface of each of the middle sleeves 9, 23 to the handle 2 during manufacturing, as will be discussed in detail below.

As shown in FIGS. 6-8, the second sleeve 9 and the fifth sleeve 23 (the pre-formed middle sleeves) are each attached to the pre-formed handle 2 via a hinge 42, or tab. Each hinge 42 is a generally flat piece of material, being part of a template 43, configured such that each hinge 42 can be folded during manufacturing in order to position each of the middle sleeves 9, 23 between the end sleeves 5, 15, 19, 29 along each side of the handle 2. Each hinge 42 preferably has a crease such that the hinge 42 is folded along the crease. In FIGS. 6-8, the crease is indicated by the dotted line on each hinge 42. Each hinge 42 is attached at one end to the pre-formed handle 2 and at the opposite end to one of the pre-formed middle sleeves 9, 23. In a preferred embodiment, as seen in FIGS. 6-8, each hinge 42 is attached to the pre-formed handle 2 at each of the perforated handle attachment panels 14, 28. In another preferred embodiment, as seen in FIGS. 6 and 7, each hinge 42 is attached to each pre-formed middle sleeve 9, 23 at approximately the center of each of the sleeves. In addition, as shown in FIGS. 7 and 8, each hinge 42 has perforations (indicated by dashed lines) at each end of the hinge 42 such that each of the hinges 42 can be detached from the beverage carrier 1 after assembly by tearing the perforations. In order to manufacture a beverage carrier 1 having six or more sleeves, which is described in greater detail below, the use of hinges 42 is advantageous because it allows the template 43 to be cut from a single piece of material without overlapping the material used to form each of the sleeves 5, 9, 15, 19, 23, 29. The middle sleeves 9, 23 can simply be folded into place between the end sleeves 5, 15, 19, 29 by folding each of the hinges 42. Utilizing a cut-out template 43 made from a single, generally flat piece of material without overlapping parts is advantageous because it allows a high volume of beverage carriers to be manufactured quickly using automated systems.

Figure 3:
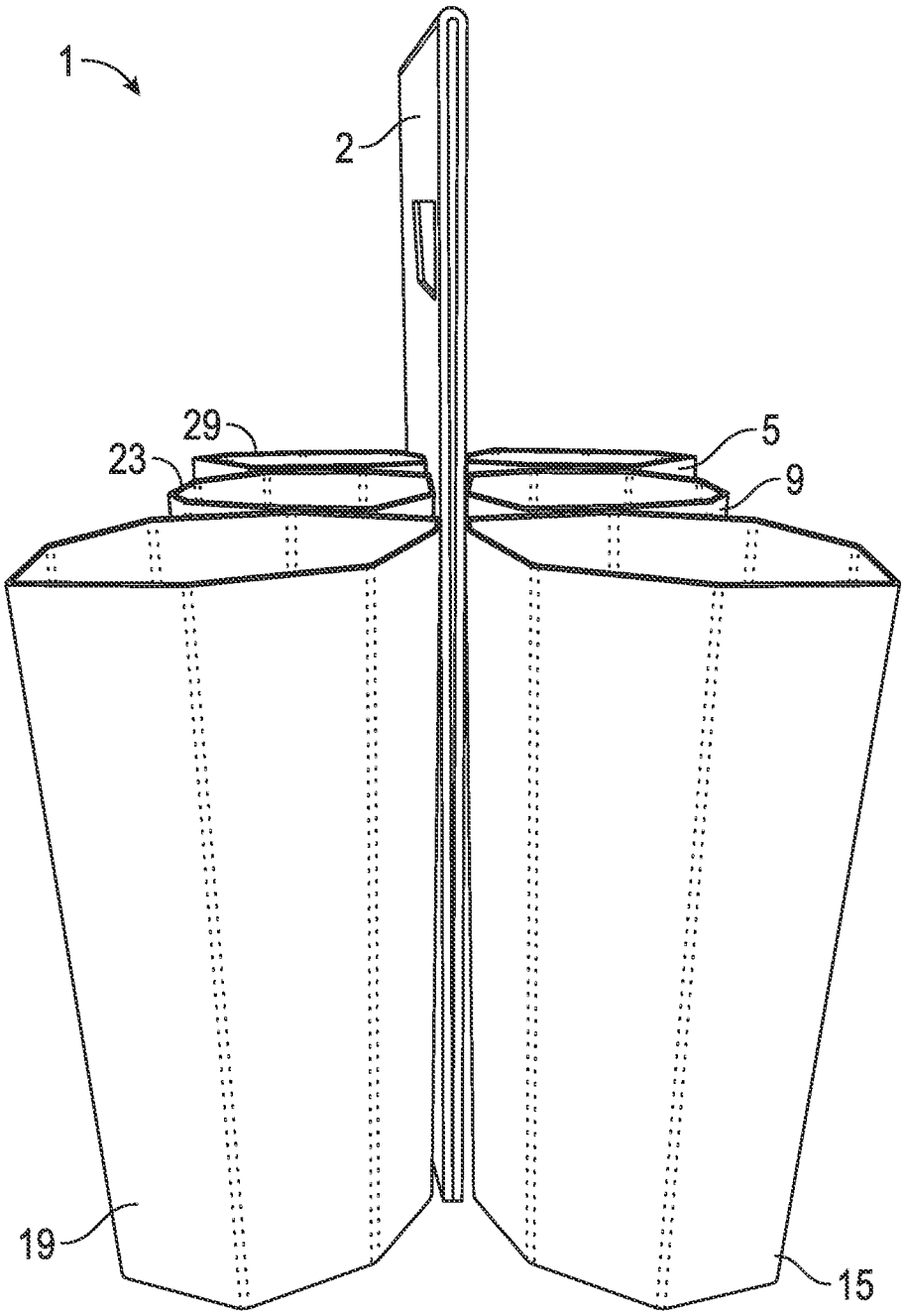
FIG. 3 depicts a front view of the beverage carrier of the present invention.
Figure 4:
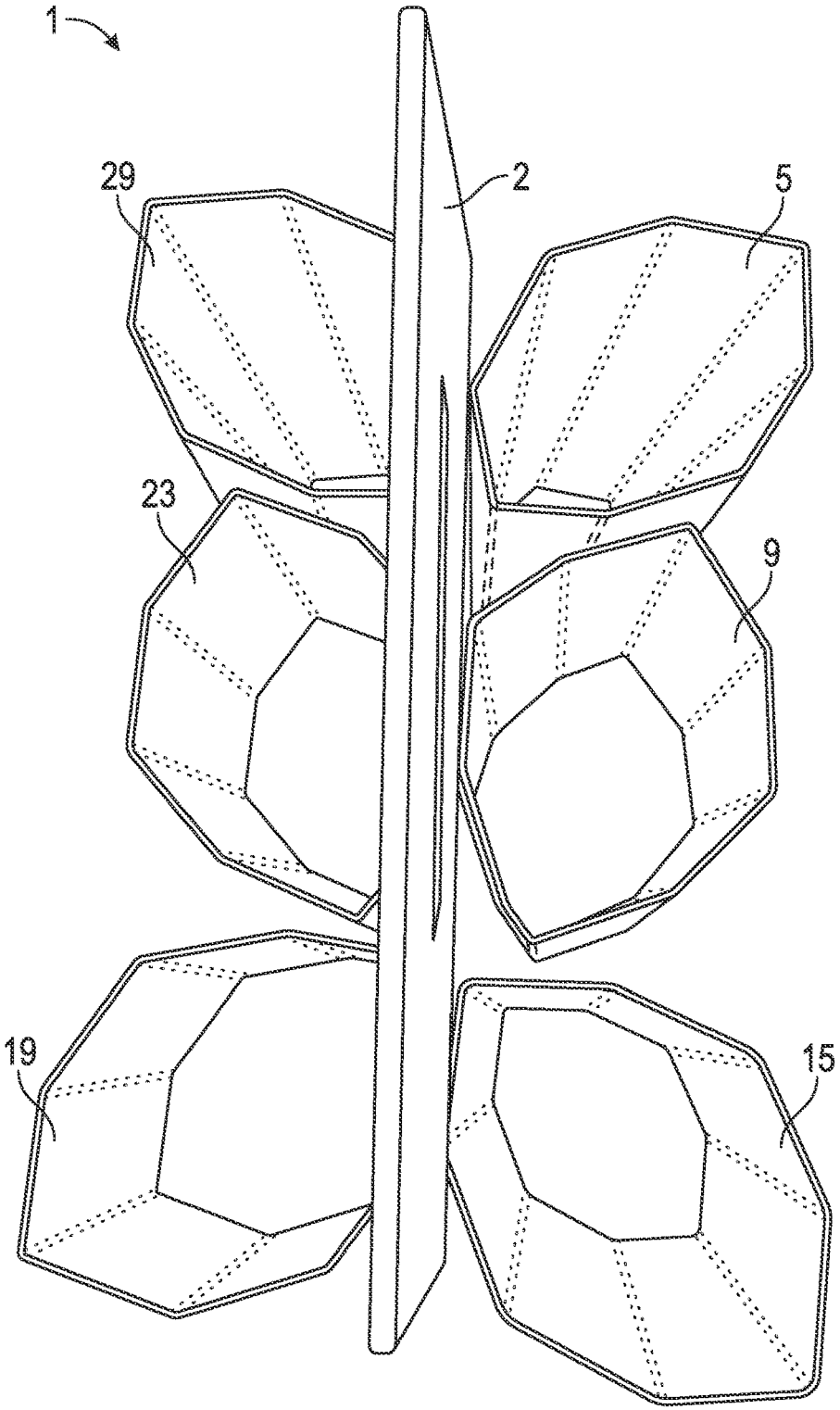
FIG. 4 depicts a top view of the beverage carrier of the present invention.

When the beverage carrier 1 is assembled and in an upright position, each perforated attachment surface 60, 61, 62, 63, 64, 65 is configured in a generally vertical position along the exterior surface of each respective three-dimensional sleeve 5, 9, 15, 19, 23, 29, as shown in FIG. 1. FIGS. 6-8 illustrate the generally straight and generally vertical configuration of each perforated attachment surface 60, 61, 62, 63, 64, 65 relative to each respective sleeve 5, 9, 15, 19, 23, 29 prior to assembly of the carrier 1. Thus, after assembly of the carrier 1, each perforated attachment surface 60, 61, 62, 63, 64, 65 extends vertically in a generally straight line along the exterior surface of each sleeve 5, 9, 15, 19, 23, 29 rather than horizontally along a curved line around the circular perimeter of the sleeve. This vertical, straight-line configuration allows each sleeve 5, 9, 15, 19, 23, 29 to fit snugly around the entire circular perimeter of each respective beverage container without bending the handle 2. Thus, the handle 2 remains in a generally flat configuration after assembly, as shown in FIGS. 2-4. The tight fit of each sleeve around each respective beverage container, as shown in FIGS. 12-14, provides effective insulation to substantially reduce heat transfer between the beverages and the surrounding environment. Additionally, the flattened shape of the handle 2 prevents unwanted or unintentional tearing of the perforated attachment surfaces 60, 61, 62, 63, 64, 65 by not causing the attachment surfaces to bend. The flattened shape of the handle 2 also allows assembly of the carrier 1 using automated machinery without tearing the attachment surfaces 60, 61, 62, 63, 64, 65, which is discussed in detail below.

FIG. 7 depicts an elevational view of a paperboard cut-out template 43 to create the beverage carrier 1 shown in FIGS. 1-5. FIGS. 6 and 8 each depict an elevational view of a paperboard cut-out template 43 to create an alternative embodiment of beverage carrier 1. Advantageously, the beverage carrier 1 may be cut from a blank, or, in other words, a single piece of paperboard or other material. For example, a 24 inch by 21.5 inch piece of 18 point or 24 point AquaKote® (Wet Strength CCK) paperboard may be used as the blank. In FIGS. 6-8, the solid lines indicate cuts that are to be made to the blank to create the specific shape of the beverage carrier template 43. The dotted lines indicate creases or folds that are made to the blank, and the dashed lines indicate perforations that are made to the blank.

The beverage carrier templates 43 can be cut and assembled by manual or by automated means already known in the art. The following describes one method of creating a beverage carrier 1 using automated means. In the following description, the blank is referred to as having a top side and a bottom side wherein the top side faces upwards and the bottom side faces downwards during assembly. Referring to FIGS. 6-8, which depict an aerial view looking downward on the top side of the blank, the blank may be cut and perforated using an automated die cutter, such as a BOBST® Flatbed Die-Cutter. The die cutter, using the schematic that is uploaded to the die cutter (where FIGS. 6-8 are materially similar to such a schematic), makes cuts corresponding to the solid lines and further makes perforations corresponding to the dashed lines. The perforations, which are a combination of punctures and small cuts, may comprise various sequences of punctures and cuts, and as an example, may comprise the alternating sequence of three punctures and one cut.

After the cuts and perforations are made by the die cutter, the beverage carrier template 43 is assembled by a folder-gluer line (such as a BOBST® Folder Gluer). The folder-gluer line, using the schematic that is uploaded to the folder-gluer line (where FIGS. 6-8 are materially similar to such a schematic), first makes creases (also known as scores) to the beverage carrier template 43 corresponding to the dotted lines of the schematic. The folder-gluer line then applies glue to the template 43 in the appropriate locations for assembling the carrier 1, depending on the particular embodiment of the carrier 1 and the particular template 43 used.

FIG. 7 illustrates a preferred embodiment of the template 43. In a preferred embodiment, the folder-gluer line applies glue to the bottom side of each of the sleeve attachment flaps 6, 10, 16, 20, 24, 30, to the top side of a first handle attachment panel 14, to the top side of a second handle attachment panel 28, and to the top side of the inner portion 4 of the pre-formed handle 2. Alternatively, or in addition to, glue may also be applied to the top side of each of the sleeve attachment panels 8, 12, 18, 22, 26, 32, and to the bottom side of each of the second and fifth sleeve inner attachment panels 13, 27.

Next, the folder-gluer line attaches the bottom side of the first sleeve attachment flap 6 to the top side of the first sleeve attachment panel 8 by bending the attachment flap 6 upward and curving the flap 6 until it touches the attachment panel 8. This step forms the generally cylindrical first sleeve 5. Similarly, the folder-gluer line next attaches the bottom side of the sixth sleeve attachment flap 30 to the top side of the sixth sleeve attachment panel 32 in the same manner to form the generally cylindrical sixth sleeve 29. Then, the folder-gluer line attaches the bottom side of the third sleeve attachment flap 16 to the top side of the third sleeve attachment panel 18 to form the generally cylindrical third sleeve 15, and also attaches the bottom side of the fourth sleeve attachment flap 20 to the top side of the fourth sleeve attachment panel 22 to form the generally cylindrical fourth sleeve 19.

In a preferred embodiment, the folder-gluer line then attaches the bottom side of the second sleeve attachment flap 10 to the top side of the second sleeve attachment panel 12 by bending both the flap 10 and the panel 12 upward until the flap 10 touches the panel 12. This step forms the generally cylindrical second sleeve 9. Similarly, the folder-gluer line next attaches the bottom side of the fifth sleeve attachment flap 24 to the top side of the fifth sleeve attachment panel 26 to form the generally cylindrical fifth sleeve 23.

Figure 4A:
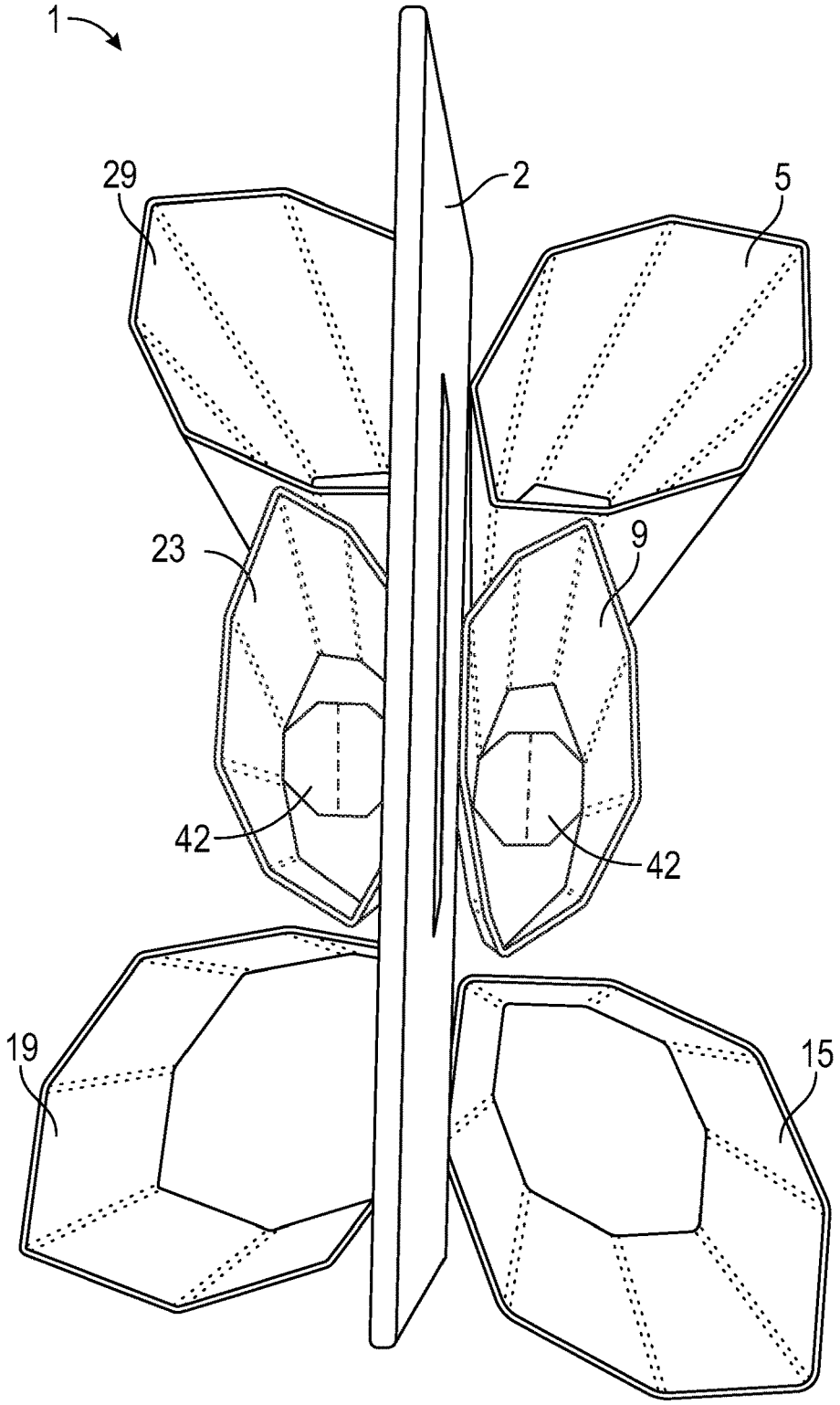
FIG. 4A depicts the beverage carrier shown in FIG. 4 before the removal of hinges connecting the middle sleeves to the handle.
Figure 5:
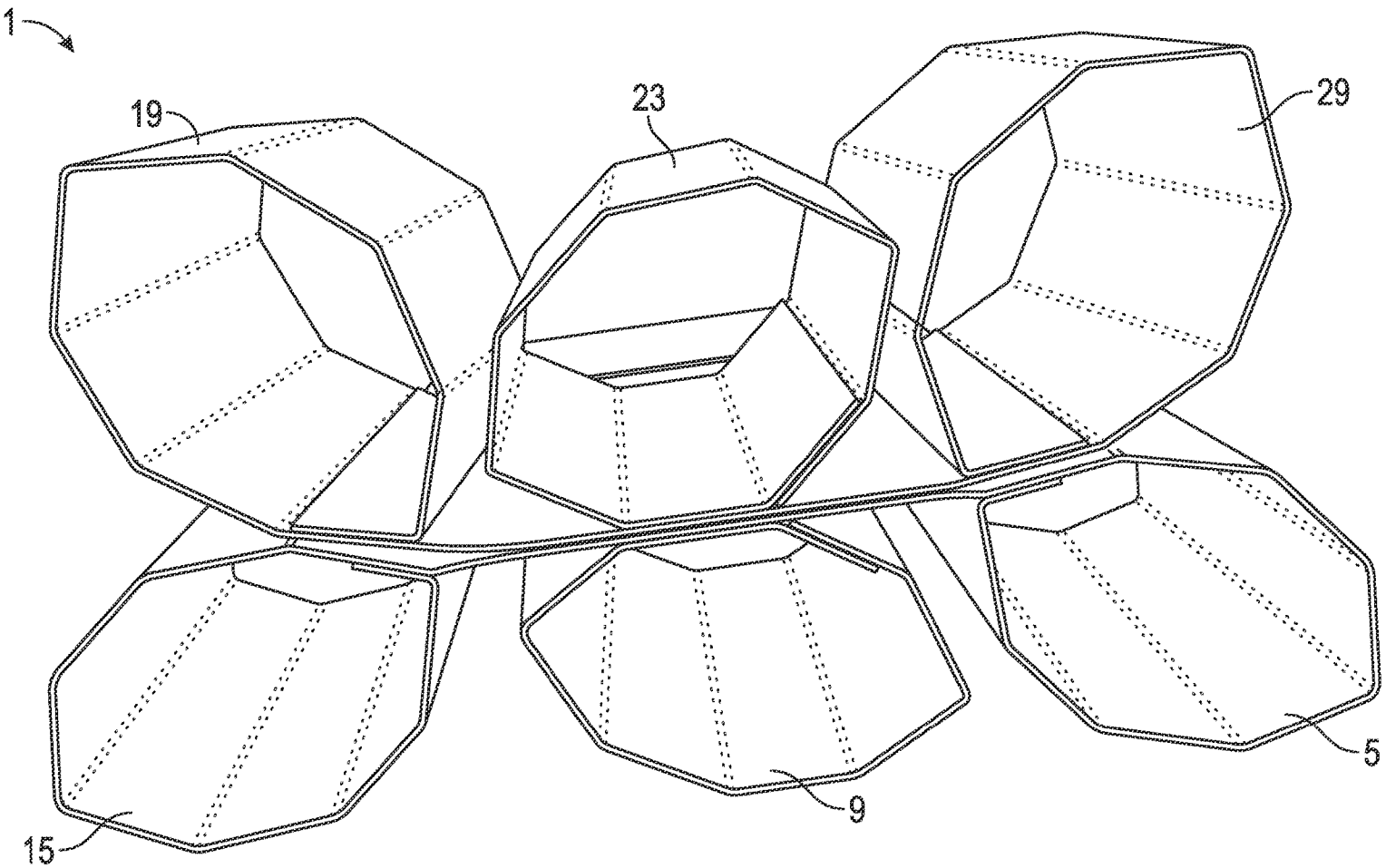
FIG. 5 depicts a bottom view of the beverage carrier of the present invention.
Figure 5A:
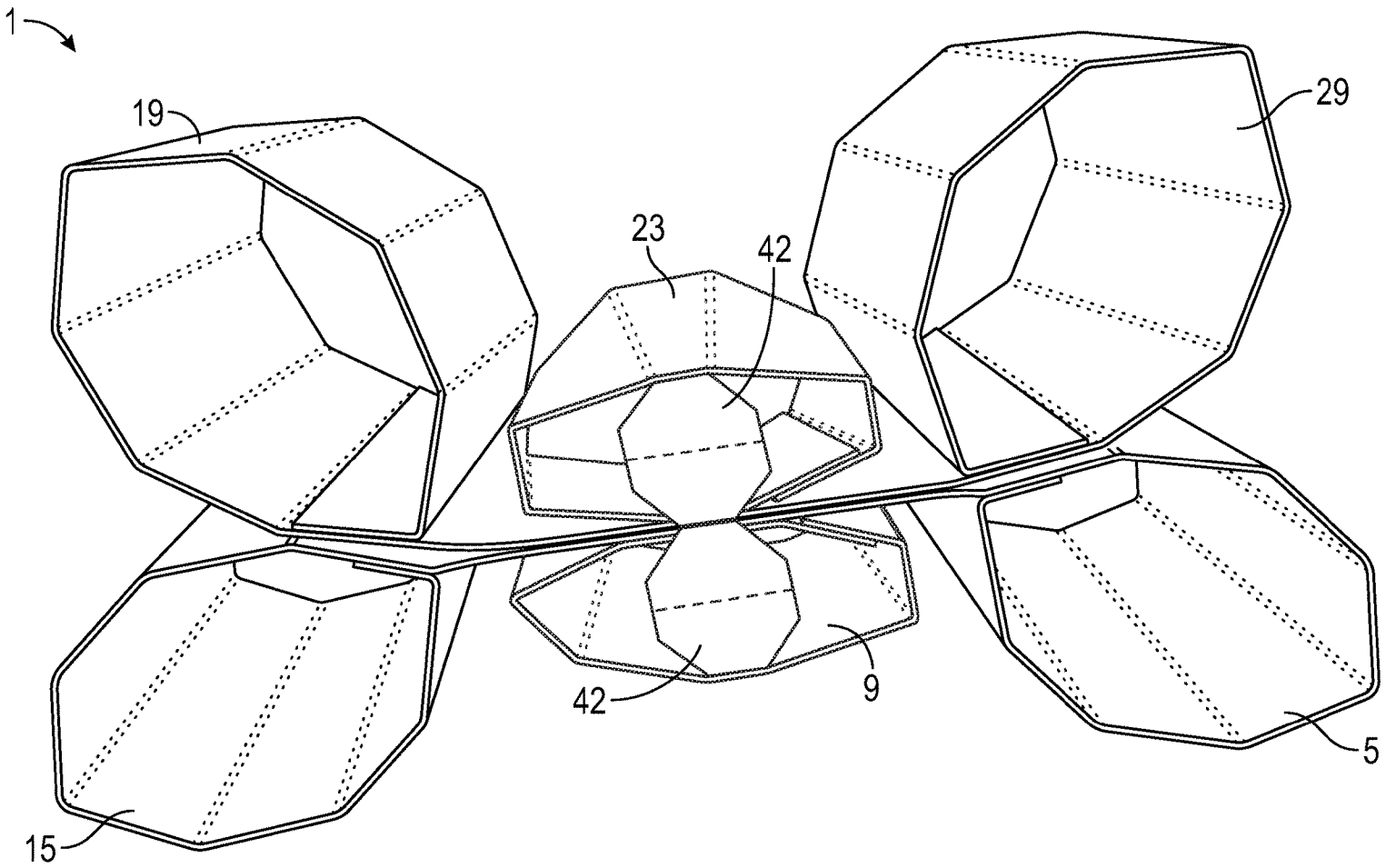
FIG. 5A depicts the beverage carrier shown in FIG. 5 before the removal of hinges connecting the middle sleeves to the handle.

The folder-gluer line then folds the second sleeve 9 and the fifth sleeve 23 upward by bending each hinge 42 along the crease in each hinge 42, thereby creating the fold. The middle sleeves 9, 23 are folded such that the bottom side of the second sleeve inner attachment panel 13 becomes glued to the top side of the perforated first handle attachment panel 14, and the bottom side of the fifth sleeve inner attachment panel 27 becomes glued to the top side of the perforated second handle attachment panel 28. Thus, the exterior surface of each of the three-dimensional middle sleeves 9, 23 is attached to each perforated handle attachment panel 14, 28, respectively, and is thus attached to each side of the handle 2, respectively. After attachment of the second and fifth sleeves 9, 23 to the handle 2, each of the hinges 42 are removed from the assembly by tearing the hinges 42 along the perforations on each side of each hinge 42. Removal of the hinges 42 from the assembly will allow the second and fifth sleeves 9, 23 to expand so that each sleeve may be used to hold a beverage container. FIGS. 4A and 5A illustrate the assembly prior to removal of the hinges 42 by tearing along the perforations on each side of each hinge 42. FIGS. 4 and 5 illustrate the assembly with the hinges 42 removed and the second and fifth sleeves 9, 23 expanded.

The inner portion 4 of the pre-formed handle 2 is then folded downward under the outer portion 3, and the pre-formed handle 2 is folded in half along the creases (shown by the dotted lines in FIGS. 6-8) to form the handle 2 of the assembled beverage carrier 1 as shown in FIGS. 1-4. After the handle 2 is folded in half, the beverage carrier 1 will have six sleeves 5, 9, 15, 19, 23, 29 arranged in two rows of three sleeves on either side of the handle 2, thereby forming a symmetrical carrier 1 designed to carry six individual beverage containers, as illustrated in FIG. 2.

In an alternative embodiment, the second sleeve 9 and the fifth sleeve 23 may be attached to the perforated handle attachment panels, 14 and 28, respectively, by gluing the bottom side of the second and fifth sleeve attachment panels 12, 26 to the handle attachment panels, 14 and 28, respectively. In fact, it should be understood by one skilled in the art that any of the sleeve panels 11, 25 illustrated in FIGS. 6-8 may be used for attachment to the handle 2 and still fall within the scope of the present invention.

In another alternative embodiment, the second sleeve 9 and the fifth sleeve 23 can be formed by bending the respective sleeve attachment panels 12, 26 and sleeve attachment flaps 10, 24 downward (as opposed to upward as in the previously discussed embodiments) until each of the flaps 10, 24 touches the corresponding panels 12, 26. In this embodiment, the second and fifth sleeves 9, 23 are then folded upward by folding the crease in each hinge 42 so that the top side of each center attachment panel 50, 51 is attached to the top side of its corresponding perforated handle attachment panel 14, 28. Thus, in this embodiment, the attachment panels 12, 26 and the attachment flaps 10, 24, which overlap and are glued together, are positioned on the outside of the sleeves 9, 23 when viewing the assembled carrier 1. However, it is preferred that the outside portions of the middle sleeves 9, 23 have a smooth continuous surface for the purpose of printing on the sleeves and generally for aesthetic purposes. Thus, this embodiment is not the most preferred.

Another alternative embodiment of the present invention utilizes the template illustrated in FIG. 6. The primary advantage of this template is that it utilizes less material due to the smaller size of each of the hinges 42. In this embodiment, the middle sleeves 9, 23 may be formed by bending the respective attachment panels 12, 26 and attachment flaps 10, 24 upward or downward, as described above. In addition, the middle sleeves 9, 23 may be attached to the respective perforated handle attachment panels 14, 28 in any manner described above. After assembly, each of the hinges 42 is torn along the crease shown on each hinge 42 in FIG. 6. Alternatively, the crease in each hinge 42 may instead be a perforation in order to make it easier to tear each hinge 42. By tearing each hinge 42, the second and fifth sleeves 9, 23 are allowed to expand so that each sleeve may be used to hold a beverage container.

Another alternative embodiment of the present invention utilizes the template illustrated in FIG. 8. In this embodiment, the location where each hinge 42 is attached to each middle sleeve 9, 23 is offset from the center of the sleeves 9, 23. The middle sleeves 9, 23 in this embodiment may be formed in any manner described above. However, in this embodiment it is preferred to attach the second and fifth sleeves 9, 23 to the handle 2 by attaching the bottom side of each inner attachment panel 13, 27 to the top side of the corresponding handle attachment panel 14, 28, though any method of attachment described above may also be utilized. Depending on the material of construction, this configuration of the template may make it easier to attach the bottom side of each inner attachment panel 13, 27 to the corresponding handle attachment panel 14, 28.

Although the methods described above produce a beverage carrier 1 designed to carry six beverage containers, the method may be adapted to produce a beverage carrier 1 designed to carry more than six beverage containers, and particularly a carrier for carrying eight beverage containers. For instance, to produce a carrier having eight individual sleeves, the template shown in FIG. 8 can be modified to add one additional pre-formed sleeve attached to each side of the pre-formed handle. In this embodiment, the pre-formed handle 2 is widened and would include two separate perforated attachment panels and two separate hinges on each side of the pre-formed handle 2. Thus, each side of the pre-formed handle would have two end sleeves and two middle sleeves attached thereto. Each pre-formed middle sleeve would be offset to one side in a similar manner to the pre-formed middle sleeve shown in FIG. 8 so that the two middle sleeves on each side of the pre-formed handle would not overlap. Thus, the beverage carrier could still be made from a template comprising a single piece of material without any overlapping material, which would allow the carrier to be manufactured by automated systems in a similar manner as described above.

After assembly, beverage containers can be placed into the sleeves 5, 9, 15, 19, 23, 29 either manually or by automated means. FIGS. 12-14 depict the assembled beverage carrier 1 with bottles inserted into the sleeves 5, 9, 15, 19, 23, 29. The perforations made during assembly allow for a user to easily detach each sleeve 9, 15, 19, 23, 29 individually from the beverage carrier 1 by pulling the sleeve (or by pulling on the bottle contained within the sleeve) away from the beverage carrier 1, thereby tearing the perforated attachment surface 60, 61, 62, 63, 64, 65. As shown in FIG. 13, after detaching the sleeved container from the remainder of the beverage carrier 1, each sleeve 5, 9, 15, 19, 23, 29 remains structurally intact. In other words, after detaching a sleeved container, the user can then allow the sleeve 5, 9, 15, 19, 23, 29 to remain on the beverage container and use the sleeve 5, 9, 15, 19, 23, 29 as an insulating device for the container to reduce the transfer of heat from external heat sources, such as heat from the environment or heat from the user's hand, to the container during use. Conversely, the sleeve 5, 9, 15, 19, 23, 29 also protects the user's hand from becoming too cold when holding a cold beverage container. Additionally, although the device is typically used to insulate cold beverages, it may also be used in the same manner to insulate hot beverages.

Figure 9:
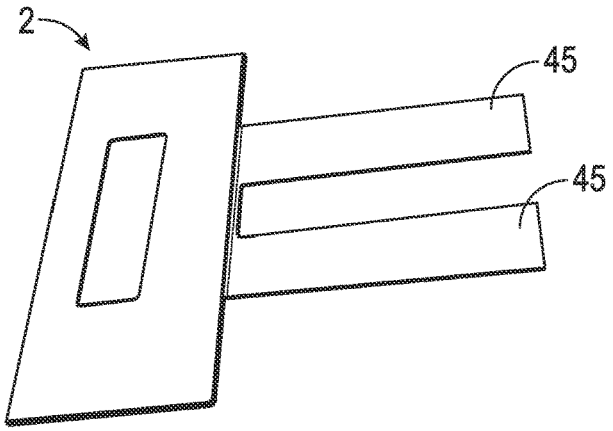
FIG. 9 depicts an elevational view of the handle after removal of all sleeve bodies.
Figure 10:
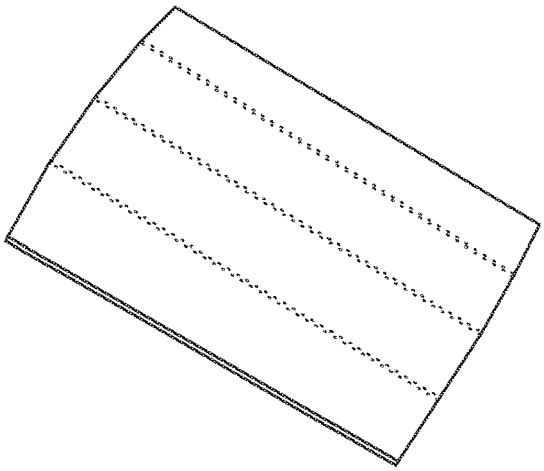
FIG. 10 depicts an elevational view of a single sleeve body while flattened.

Alternatively, if the bottles are going to be placed into an ice chest or a location where it is undesirable to have the containers in sleeves 5, 9, 15, 19, 23, 29, the user can remove the beverage containers from the sleeves 5, 9, 15, 19, 23, 29. Advantageously, as shown in FIGS. 9-11, the sleeves 5, 9, 15, 19, 23, 29 can then be nested within each other and stored on the handle 2 of the beverage carrier 1 for later use. As illustrated in FIG. 9, after all of the sleeves 5, 9, 15, 19, 23, 29 have been detached from the beverage carrier 1, the handle 2 remains. As illustrated in FIGS. 6-8 and described above with respect to the method of manufacturing, the handle 2 comprises an inner portion 4 folded underneath an outer portion 3. The handle 2 further comprises a lower portion 45, which comprises the portions of the handle 2 previously (before detachment of the sleeves) bordered by the first handle attachment panel 14 and the first and third sleeve attachment panels 8, 18, as well as the portions of the handle previously bordered by the second handle attachment panel 28 and the fourth and sixth sleeve attachment panels 22, 32. In one embodiment, the two separate portions of the handle that form the lower portion 45 shown in FIG. 9 may be glued together during manufacturing by applying glue to the bottom side of either or both of these portions before folding the pre-formed handle in half to form the handle 2. The lower portion 45 is sized such that the sleeves 5, 9, 15, 19, 23, 29 can be nested on the lower portion 45, as shown in FIG. 11.

In alternative embodiments, the handle may be made of a different material from that used to form the individual sleeves. For example, the handle may be made of cardboard, while the individual sleeves are made of a different material, such as, but not limited to, foam rubber or neoprene. In another exemplary embodiment, the handle and sleeves can be formed from separate pieces of material assembled together to form a single carrier with multiple sleeves during the manufacturing process (as opposed to being cut from a single sheet of material as described above). In another exemplary embodiment, we speculate that the various contacts between the various portions of the carrier can be fixed via methods other than glue, including interlocking tabs, structured board (i.e., one-way insertion methods), hinges, tacks, staples, zippers, hook and loop tape (e.g., "Velcro"), sewn thread, springs, clips, buckles, hooks, magnets, nails, screws, suction or any similar attachment means know in the art.

It is understood that versions of the invention may come in different forms and embodiments. Additionally, it is understood that one of skill in the art would appreciate these various forms and embodiments as falling within the scope of the invention as disclosed herein.

What is claimed is:

1. A beverage carrier for carrying beverage containers, wherein said beverage carrier is formed from a unitary piece of material, said carrier comprising:

a handle having a first side and a second side; and six sleeves arranged in a first row and a second row, wherein the first row is disposed along a length of the first side of the handle and the second row is disposed along a length of the second side of the handle, wherein an exterior surface of each respective sleeve is attached to the handle, wherein the first row comprises three sleeves including a first middle sleeve and the second row comprises three sleeves including a second middle sleeve, wherein the first middle sleeve and the second middle sleeve are each additionally foldably attached to the handle by a hinge attached to a bottom end of each of the first middle sleeve and the second middle sleeve, respectively, and wherein each respective sleeve is configured to individually detach from the handle while remaining structurally intact.

2. The beverage carrier of claim 1, wherein each hinge attaching the first middle sleeve and the second middle sleeve, respectively, has perforations configured to detach the hinge from the beverage carrier.

3. The beverage carrier of claim 1, wherein the exterior surface of each respective sleeve is attached to the handle along a perforated attachment surface.

4. The beverage carrier of claim 3, wherein each respective perforated attachment surface is configured in a generally vertical position when the beverage carrier is in an upright position.

5. The beverage carrier of claim 1, wherein each sleeve comprises a top end and a bottom end, where an upper diameter of the top end is greater than a lower diameter of the bottom end.

6. The beverage carrier of claim 5, wherein each respective sleeve is holding an individual beverage container, wherein a lower void exists between a bottom of each beverage container and the bottom end of each respective sleeve.

7. The beverage carrier of claim 1, wherein each sleeve comprises a support segment configured to support a beverage container held within the sleeve.

* * * * *